US010767360B2

(12) United States Patent
Lappalainen et al.

(10) Patent No.: US 10,767,360 B2
(45) Date of Patent: Sep. 8, 2020

(54) TOILET ARRANGEMENT

(71) Applicant: EVAC OY, Espoo (FI)

(72) Inventors: Vesa Lappalainen, Vantaa (FI); Kaj Rönnblad, Vantaa (FI)

(73) Assignee: EVAC OY, Espoo (FI)

( * ) Notice: Subject to any disclaimer, the term of this patent is extended or adjusted under 35 U.S.C. 154(b) by 0 days.

(21) Appl. No.: 16/076,624

(22) PCT Filed: Feb. 7, 2017

(86) PCT No.: PCT/FI2017/050067
§ 371 (c)(1),
(2) Date: Aug. 8, 2018

(87) PCT Pub. No.: WO2017/140942
PCT Pub. Date: Aug. 24, 2017

(65) Prior Publication Data

US 2019/0040617 A1 Feb. 7, 2019

(30) Foreign Application Priority Data

Feb. 16, 2016 (FI) ..... 20165110

(51) Int. Cl.
*E03F 1/00* (2006.01)
*E03D 11/02* (2006.01)
(Continued)

(52) U.S. Cl.
CPC ..... *E03F 1/006* (2013.01); *E03D 3/10* (2013.01); *E03D 5/024* (2013.01); *E03D 11/02* (2013.01); *E03D 11/13* (2013.01); *E03D 2201/20* (2013.01)

(58) Field of Classification Search
CPC .. E03F 1/006; E03F 1/007; E03D 3/10; E03D 11/02; E03D 11/13; E03D 11/14; E03D 11/16; E03D 11/17
See application file for complete search history.

(56) References Cited

U.S. PATENT DOCUMENTS 3,695,284 A * 10/1972 Wallgren ..... E03D 3/06 137/188
3,732,579 A 5/1973 Allander et al.
(Continued)

FOREIGN PATENT DOCUMENTS

CN 1111704 A 11/1995
CN 1303976 A 7/2001
(Continued)

OTHER PUBLICATIONS

Search Report for related Finland Application No. 20165110; report dated Sep. 15, 2016.
(Continued)

*Primary Examiner* — J C Jacyna
(74) *Attorney, Agent, or Firm* — Miller, Matthias & Hull LLP

(57) ABSTRACT

Toilet arrangement, which includes a gravity toilet bowl (1) provided with a water trap (11) and an outlet (12). The arrangement further includes a water valve (5), a flush water tank (4), and a flush valve (6) arranged between the flush water tank (4) and the toilet bowl (1), and an activating means (8) for activating a flushing sequence. In order to allow for the use of a standard gravity toilet bowl in connection with a vacuum sewage system, the toilet arrangement comprises an adapter (13) which is arranged between the gravity toilet bowl (1) and a discharge valve (2) connected to a vacuum sewer piping (3). A control mechanism (7) is connected to the vacuum sewer piping (3), the discharge valve (2), the water valve (5) and the flush valve (6), whereby the control mechanism (7) is arranged to be activated by means of the activating means (8).

6 Claims, 5 Drawing Sheets

(51) Int. Cl.

| | |
|---|---|
| ***E03D 3/10*** | (2006.01) |
| ***E03D 5/02*** | (2006.01) |
| ***E03D 11/13*** | (2006.01) |

(56) References Cited

U.S. PATENT DOCUMENTS

| | | | | | |
|---|---|---|---|---|---|
| 4,275,470 | A * | 6/1981 | Badger | B64D 11/02 | 251/5 |
| 4,621,379 | A * | 11/1986 | Kilpi | E03F 1/006 | 137/205 |
| 4,707,868 | A * | 11/1987 | Hennessy | E03D 3/10 | 4/354 |
| 4,783,859 | A * | 11/1988 | Rozenblatt | B64D 11/02 | 251/129.12 |
| 5,133,853 | A * | 7/1992 | Mattsson | E03F 1/006 | 210/104 |
| 5,301,374 | A * | 4/1994 | Smiley | E03D 11/025 | 4/341 |
| 5,937,888 | A * | 8/1999 | McKiernan | E03D 5/00 | 137/205 |
| 6,085,366 | A | 7/2000 | Pondelick et al. | | |
| 6,128,789 | A * | 10/2000 | Olav | E03F 1/006 | 4/431 |
| 6,243,887 | B1 | 6/2001 | Palffy et al. | | |
| 7,207,073 | B1 | 4/2007 | Blankenburg | | |
| 8,196,232 | B2 * | 6/2012 | Van Herp | E03D 11/14 | 4/224 |
| 8,468,616 | B2 * | 6/2013 | Song | E03F 1/006 | 4/431 |
| 2002/0189669 | A1 * | 12/2002 | Lappalainen | E03F 1/006 | 137/205 |
| 2007/0226887 | A1 * | 10/2007 | Lappalainen | E03F 1/006 | 4/431 |
| 2008/0256697 | A1 * | 10/2008 | Lindroos | E03F 1/006 | 4/431 |
| 2010/0313344 | A1 * | 12/2010 | Ina | E03D 11/18 | 4/252.1 |
| 2015/0089730 | A1 * | 4/2015 | Bekki | E03D 1/14 | 4/314 |

FOREIGN PATENT DOCUMENTS

| | | | |
|---|---|---|---|
| CN | 1392313 | A | 1/2003 |
| CN | 1842628 | A | 10/2006 |
| CN | 101349072 | A | 1/2009 |
| CN | 102561488 | B | 5/2015 |
| EP | 0515134 | A1 | 5/1992 |
| FR | 2919004 | B1 | 1/2009 |
| JP | H1121982 | A | 1/1999 |
| JP | 2008255663 | A | 10/2008 |
| KR | 101479163 | B1 | 1/2015 |

OTHER PUBLICATIONS

International Search Report and written opinion for related Finland Application No. PCT/FI2017/050067; report dated Nov. 28, 2017.

* cited by examiner

TOILET ARRANGEMENT

TECHNICAL FIELD

The present invention relates to a toilet arrangement, which includes a gravity toilet bowl provided with a water trap and an outlet having a diameter corresponding to a given diameter of a gravity sewer pipe, which arrangement further includes a water valve, a flush water tank, and a flush valve arranged between the flush water tank and the gravity toilet bowl, and an activating means for activating a flushing sequence of the gravity toilet bowl, according to the preamble of claim 1.

BACKGROUND ART

Toilets used particularly in the building and housing sectors are usually so-called standard gravity toilets. Gravity systems require large diameter sewer piping, usually with a diameter of 100 mm, and require a large amount of flush water, usually between 6-10 liters, in order to ensure flushing of the sewage collected in the gravity toilet bowl, and are further fixedly and permanently installed during the construction of a building. Standard gravity toilets are available in a multitude of designs, both for floor and wall mounted installations. The diameter of a standard gravity sewer piping can vary from country to country, but usually is within a range of 90 mm to 110 mm.

A traditional set-up for a gravity toilet arrangement (FIG. 1) includes a gravity toilet bowl 101 connected to a gravity sewer pipe 103 for discharging sewage through a water trap 102 downwards into the gravity sewer pipe based on gravity. Such toilets are either supported on the floor, whereby a flush water tank 104 with the necessary volume of about 6-10 liters is mounted on the toilet itself, or mounted to a wall, or is alternatively installed in a compartment above the toilet inside the wall. In case of a wall mounted model, normally there is a supporting frame structure inside the wall for carrying the flush water tank 104, including a water valve 105 and flush valve 106, and an activating means 108 (push button connection) for activating a flushing sequence. The large flush water tank with the arrangements for the valves and the activating means require considerable space.

For the flushing sequence, the push button is pressed, the flush valve of the flush water tank is opened, whereby the flush water flows into the toilet bowl by way of gravity and empties the collected sewage in the gravity toilet bowl into the gravity sewer pipe through the water trap also based on a normal gravity flow. Thus, in order to achieve the required flush efficiency, the flush water amount has to be about 6-10 liters as mentioned above. The large amount of flush water is necessary since the flush efficiency is based on the effect of the water flow. After the flush water tank 104 is emptied through the flush valve, the flush valve 106 is closed and the flush water tank is filled with water through the water valve 105. The filling degree is controlled by a float system (not shown), which closes the water valve at a predetermined filling degree. The float system is vulnerable and apt to malfunction and may easily cause leakage of flush water into the gravity toilet bowl. The water trap provides a water lock between the gravity toilet bowl and the gravity sewer pipe.

So-called standard vacuum toilets are used in vehicles, e.g. ships, airplanes, trains, and also in buildings. The main advantages of vacuum toilets are flexibility of installation, small diameter piping, usually a diameter about 40-50 mm, and a reduced requirement of flush water, about 1.5 liters.

A standard vacuum toilet arrangement (FIG. 2) usually includes a wall mounted vacuum toilet bowl. The vacuum toilet bowl 201 is connected to vacuum sewer piping 203 through a discharge valve 202. The operational components, including an activating means (push button connection), a control mechanism, a water valve, a discharge valve, and appropriate vacuum connections, for operating the vacuum toilet are usually assembled inside the shell of the vacuum toilet bowl or behind the vacuum toilet bowl in a service space. A vacuum toilet bowl has a specific construction and design based on its intended use in a vacuum toilet system, which most often is not found desirable in view of interior design particularly in buildings and housing.

The operation principle of a vacuum toilet arrangement is as follows. In order to activate a flushing sequence, the push button 208 is pressed, which gives a pneumatic or electric signal to the control mechanism 207, which opens the discharge valve 202 and the flush water valve 206, which normally is directly connected to a line 204 of pressurized water for providing flushing water. After a timed flushing sequence, the discharge valve 202 is closed. After a given delay, the flush water valve 206 is closed, whereby a small amount of water is allowed to form in the toilet bowl 201. The vacuum needed for operation of the vacuum toilet system is generated by a vacuum unit 209.

Examples of vacuum toilet arrangements can be found e.g. in CN 102561488, U.S. Pat. No. 6,085,366 and EP 1 840 242.

Due to the operational criteria, standard vacuum toilets require a specific type of vacuum toilet bowl, which on one hand is practical in view of standard fabrication, but which on the other hand limits the design and installation freedom.

Vacuum toilet arrangements also generate considerable noise in connection with a flushing sequence. U.S. Pat. No. 4,928,326 discloses an arrangement for lessening the discharge noise, however, resulting in a surplus energy consumption due to an excessive suction of air into the vacuum sewer piping. Attempts have also been made to seal the lid of the vacuum toilet bowl, which again results in a loss of discharge effect due to a lessening of the pressure difference.

Due to the advantages of a vacuum toilet arrangement, there have been attempts to provide a combination of a gravity toilet arrangement and a vacuum sewage system, i.e. providing a gravity toilet with a vacuum sewage connection.

This has been done by connecting a gravity toilet bowl 301, including a standard so-called gravity flushing arrangement with a large (discussed above) flush water tank 304, a water valve 305, a flush valve 306, an activating means 308, and a water trap (not shown; corresponding to reference numeral 102 of FIG. 1), to a vacuum sewage system (FIG. 3). The gravity toilet bowl 301 deploys a gravity flushing arrangement as described above in connection with FIG. 1, whereby the outlet of the gravity toilet bowl 301 is connected to a vacuum interface unit 310 by means of the water trap (not shown), whereby the vacuum interface unit 310 in turn is connected to vacuum sewer piping 303 through a discharge valve 302. The interface unit, which functions as and intermediate collection tank, is dimensioned to receive a number of standard gravity flushes from the gravity toilet bowl, which necessitates a substantial volume. The filling degree of the vacuum interface unit 310, which thus functions as an intermediate waste tank, is controlled by means of an activator unit 311. When a predetermined filling degree of the vacuum interface unit 310 has been reached, the activator unit 311 activates the discharge valve 302 for discharging the contents of the vacuum interface unit into the vacuum sewer piping 303. The vacuum needed for operation of the vacuum sewage connection is generated by a vacuum unit 309.

First of all, such an installation requires two separate systems, a gravity system and a vacuum sewage system with separate operational circuits. The combination of the known systems additionally necessitates an interface unit, i.e. an intermediate waste tank, in which sewage received from the gravity toilet bowl is collected and temporarily stored. The interface unit is closed off towards the toilet bowl by means of a water trap and towards the vacuum sewer piping by means of a vacuum discharge valve.

Secondly, the interface unit requires considerable space and thus cannot be installed for easy access, e.g. above the toilet bowl. As a consequence, the vacuum discharge valve is also not easily accessible.

Thirdly, as in a traditional gravity toilet system, the amount of flush water is large, about 6-10 liters as discussed above. This is not advantageous for a vacuum sewage system, which is designed to transport small discrete slugs of sewage with volumes of air on both sides having a rising vacuum level in a downstream direction. As a consequence, the transport efficiency of the vacuum sewage system is considerably decreased. In addition this solution also creates odor problems because the vacuum interface unit is ventilated to the atmosphere in order to discharge the vacuum interface unit into the vacuum sewer piping.

SUMMARY OF THE INVENTION

An object of the invention is to avoid the above mentioned disadvantages and to achieve a flexibly installable arrangement additionally providing for freedom of choice with regard to the toilet bowl. This object is attained by a vacuum sewage system as defined in claim 1.

The basic idea of the invention is to combine a standard gravity toilet arrangement with features, particularly the operational features, of a vacuum sewage system. This can be realized by a toilet arrangement comprising a discharge valve, a vacuum sewer piping, and an adapter for providing a flow connection between the outlet, with a given first diameter of a gravity sewer pipe, and the discharge valve, with a given second diameter of the vacuum sewer piping. A first end of the discharge valve is directly connected by means of the adapter to the outlet of the gravity toilet bowl and a second end of the discharge valve, opposite to said first end, is directly connected to the vacuum sewer piping. A control mechanism is connected to the vacuum sewer piping, the discharge valve, the water valve and the flush valve, whereby the control mechanism is arranged to be activated by means of the activating means.

Normally, discharging or flushing a vacuum toilet generates a considerable noise level during a discharge sequence. A significant advantage of the present invention is a significant reduction of the noise level, which is achieved by the water trap in the gravity toilet bowl. The water trap functions as a noise reducing labyrinth. This is of particularly great importance in building and housing applications.

In an advantageous embodiment the water valve, the flush water tank, the flush valve, the control mechanism and the activating means are located above the gravity toilet bowl. This provides for easy access in view of installation, replacement, repair and maintenance. Due to the relatively small flush water tank, space requirement is considerable reduced as compared to a standard gravity toilet system.

Advantageously, also the discharge valve is located above the gravity toilet bowl for enhanced of access also to the discharge valve.

The flush water tank has a volume between 2-3 liters, which in addition to reducing space requirement also saves water in a flushing cycle as compared to a standard gravity toilet system.

The flush water consumption can be kept low in the toilet arrangement according to the invention, since the main discharge effect is based on the vacuum discharge, whereas in a standard gravity system, discharge of the gravity toilet bowl is completely based on the flow of flush water. The main function of the flush water is maintaining the gravity toilet bowl of the invention in a good hygienic condition.

The gravity toilet bowl can be of a wall mounted type or alternatively of a floor supported type.

All these features give a freedom of choice in view of design and installation, which is of great importance for both a designer and a user in the housing and building sectors.

Advantageously, a vacuum unit is connected to the vacuum sewer piping for generating vacuum in the vacuum sewer piping. The vacuum unit can be a vacuum pump, an ejector unit, or other known vacuum generating means used in vacuum sewage systems. Another alternative can be to have the vacuum sewer piping connected to a vacuum tank.

The terms "direct" and "directly" are to be understood so that the connection between the outlet of the gravity toilet bowl, with a diameter corresponding to a standard gravity sewer, and the vacuum sewer piping is simply through the adapter and the discharge valve. The adapter can include a piping section. In other words, there are no intermediate receptacles, collecting or storage tanks, such as an interface unit between the outlet and the discharge valve.

BRIEF DESCRIPTION OF THE DRAWINGS

In the following, the invention will be described, by way of example only, in more detail with reference to the attached schematic drawings, in which.

DETAILED DESCRIPTION

Figure 1:
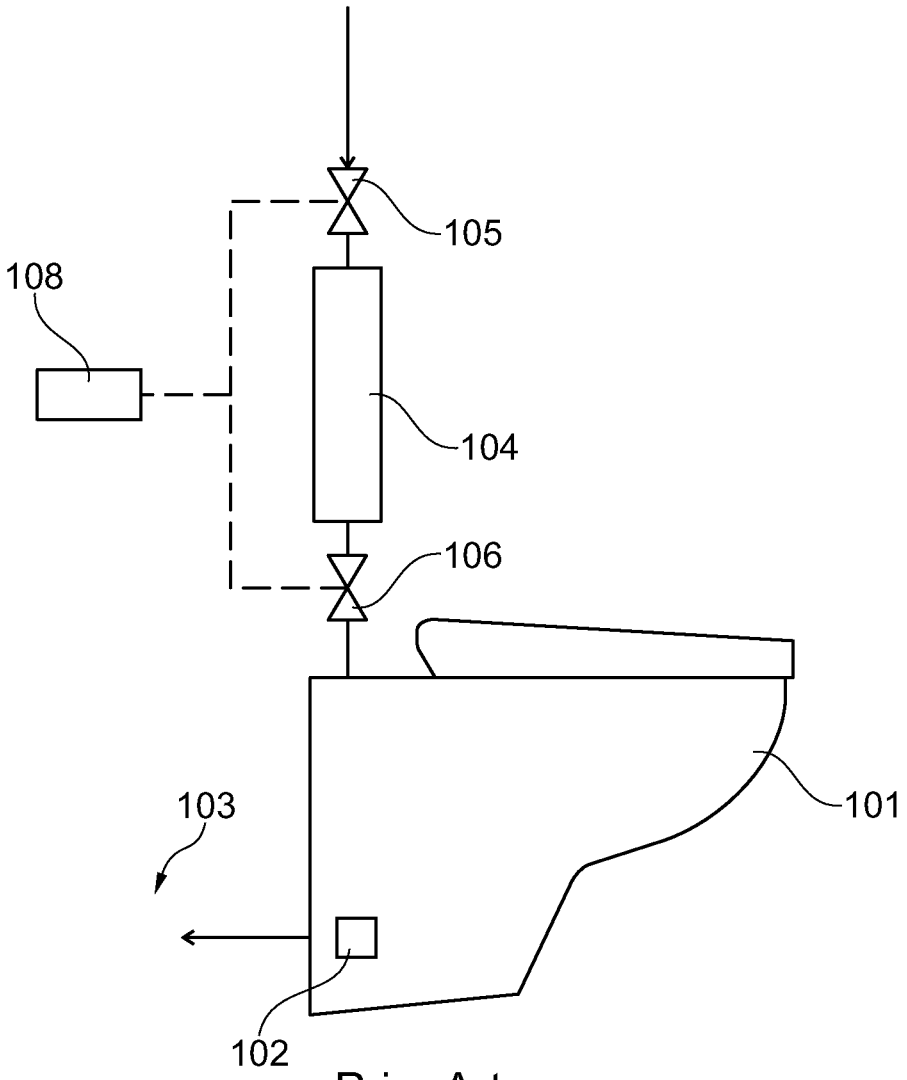
Prior Art Fig. 1
FIG. 1 illustrates a standard gravity toilet system.
Figure 2:
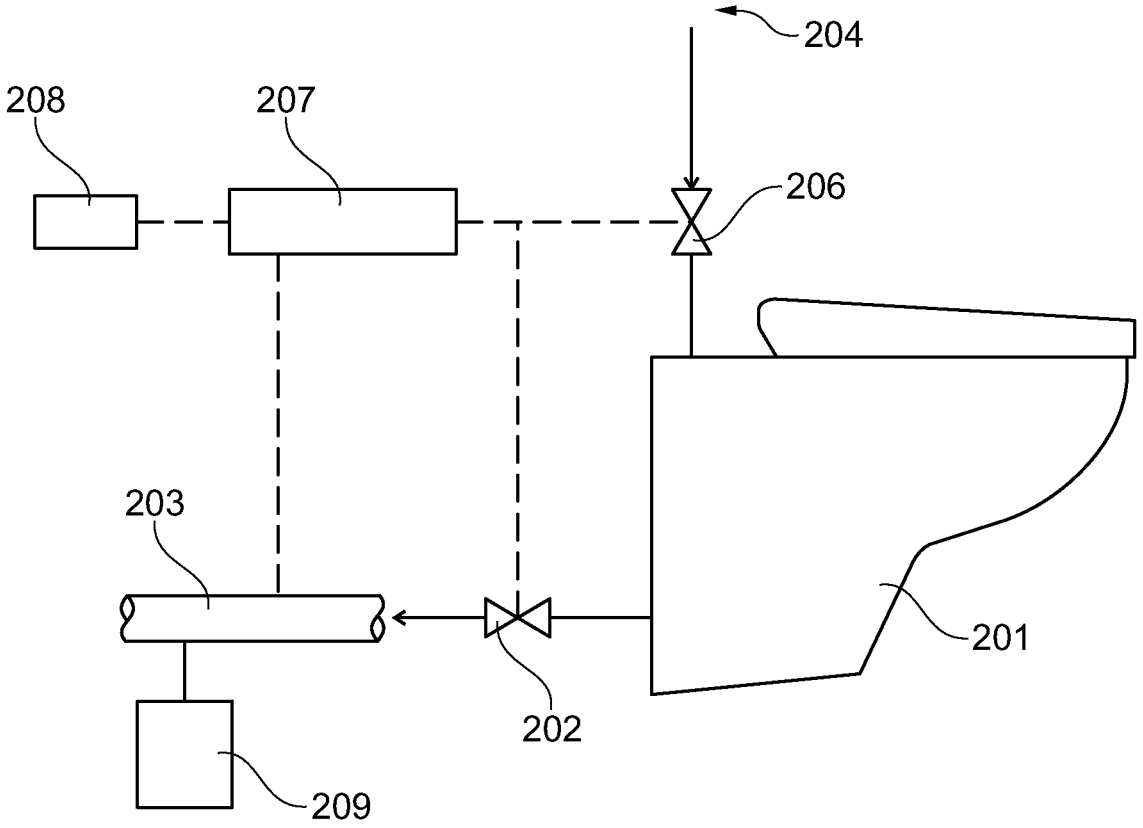
Prior Art Fig. 2
FIG. 2 illustrates a standard vacuum toilet system.
Figure 3:
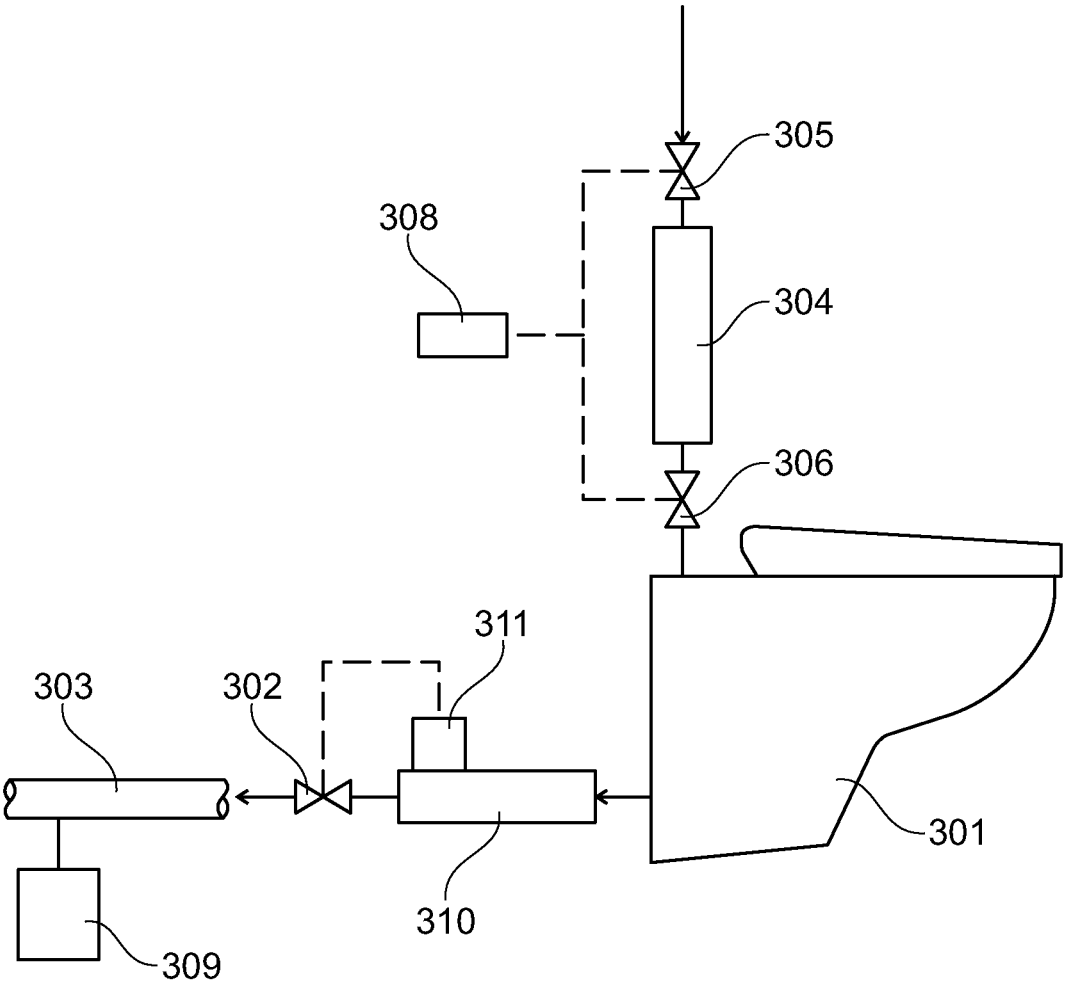
Prior Art Fig. 3
FIG. 3 illustrates a standard gravity toilet system with a traditional connection to a vacuum sewer system.

Known types of toilet arrangements are discussed above in connection with prior art and shown in FIGS. 1 to 3.

Figure 4:
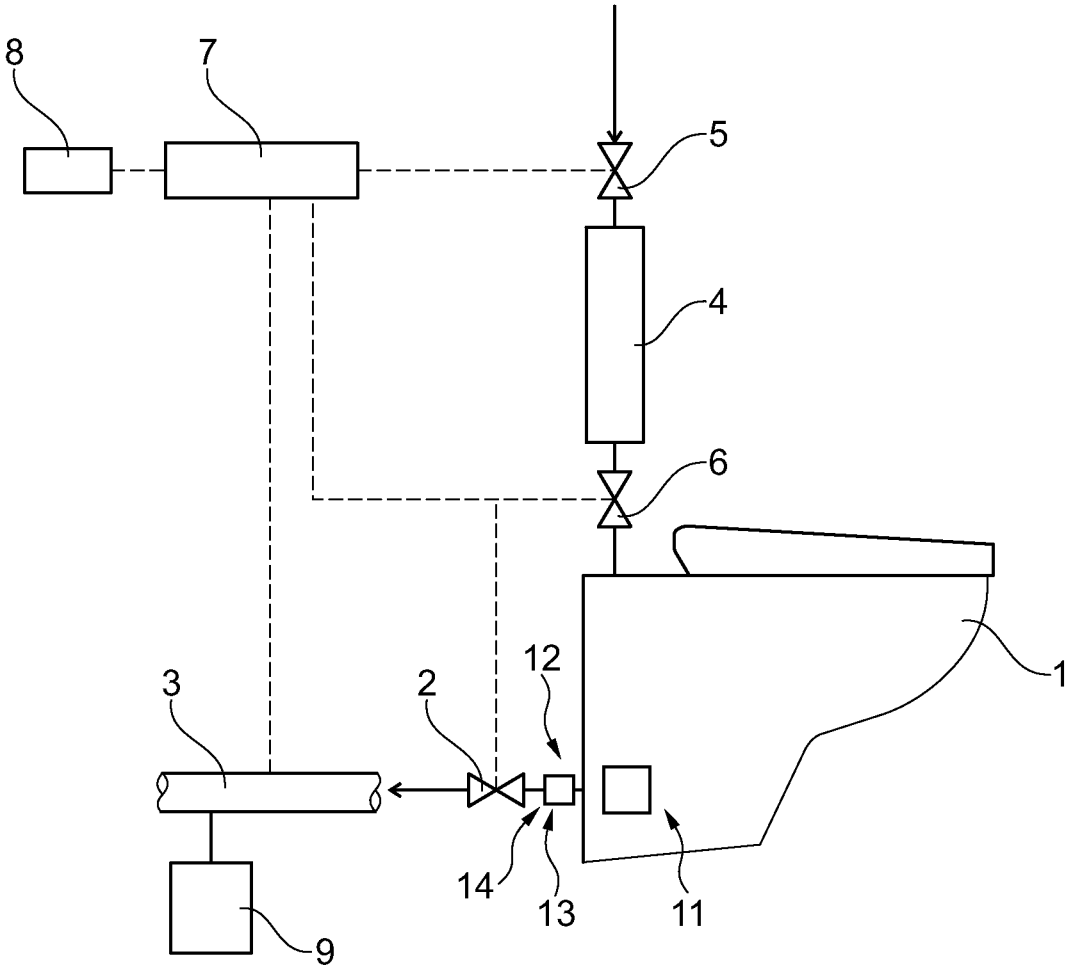
FIG. 4 illustrates a toilet arrangement according to the present invention.
Figure 5:
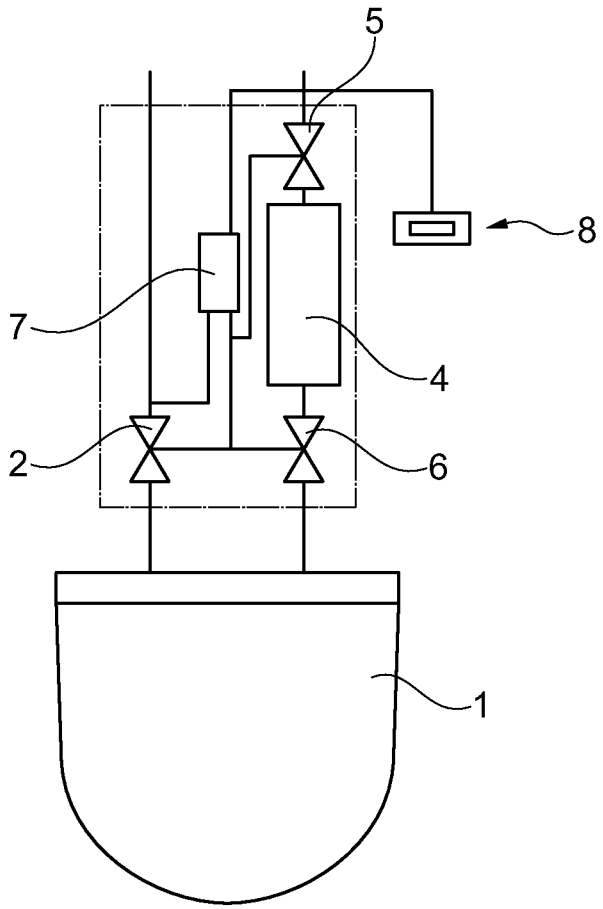
FIG. 5 illustrates the toilet arrangement according to the present invention seen from a user perspective.

The toilet arrangement according to the present invention is illustrated in FIGS. 4 and 5.

The toilet arrangement includes a gravity toilet bowl 1 provided with a water trap 11 and an outlet 12 having a diameter corresponding to a given diameter of a gravity sewer pipe. The toilet arrangement further includes a water valve 5, a flush water tank 4 and a flush valve 6, and an activating means 8 for activating a flushing sequence of the gravity toilet bowl.

The outlet 12 of the gravity toilet bowl 1 is provided with an adapter 13 which enables to connect the outlet 12 having a diameter corresponding to a given first diameter, usually between 90 mm to 110 mm, of a standard gravity sewer pipe to a vacuum sewer piping 3 with a given second diameter, usually between 40 or 50 mm.

The adapter 13 is directly connected to a vacuum sewer piping 3 by means of a discharge valve 2. In other words a first end of the discharge valve 2 is directly connected to the adapter 13 connected to the outlet 12 of the gravity toilet bowl 1 and a second end of the discharge valve 2, opposite to said first end, is directly connected to the vacuum sewer piping 3.

The direct connection indicates that there is no intermediate collecting or storage tank or other receptacle or other corresponding arrangement between the adapter 13 and the gravity toilet outlet 12. In a corresponding manner, there is no intermediate collecting or storage tank or other receptacle or other corresponding arrangement between the adapter 13 and the discharge valve 2. The adapter can include a piping section. The flow of sewage and flush water is thus directly out of the gravity toilet bowl 1 into the vacuum sewer piping 3 when the discharge valve 2 is open, i.e. normally during a discharge and flushing sequence.

In other words, there is a direct connection, without any intermediate receptacle, between the first end of the discharge valve and the adapter, and a direct connection, without any intermediate receptacle, between the second end of the discharge valve, opposite the first end, and the vacuum sewer piping.

Thus, the gravity toilet bowl can be of any standard gravity toilet bowl design. In order to make the connection to a vacuum sewer piping the adapter 13 is used for providing a reduction of the diameter of the outlet of the gravity toilet bowl to the diameter of the vacuum sewer piping with the discharge valve. Normally, there is a pipe section as indicated by reference numeral 14 between the outlet 12 of the gravity toilet bowl 1 and the discharge valve 2. The adapter can be included in the pipe section between the outlet of the gravity toilet bowl and the discharge valve. Alternatively the adapter can be directly connected to the outlet of the gravity toilet bowl, whereby the pipe section 14 continues from the adapter to the discharge valve. In other words the adapter is arranged between the outlet of the gravity toilet bowl and the discharge valve, advantageously at the outlet of the gravity toilet bowl. The sewage can freely flow through the pipe section 14, if such a pipe section is deployed.

The terms "direct" and "directly" are thus to be understood so that the connection between the gravity toilet bowl and the vacuum sewer piping is simply through the discharge valve, which is the standard manner of connection of a vacuum toilet to a vacuum sewer piping in a vacuum sewage system, and through the adapter, which in fact is only a part of the piping as such.

The toilet arrangement is provided with a flushing arrangement, which includes a flush water tank 4 connected to a source of water by means of a water valve 5. The flush water tank 4 is connected to the toilet bowl 1 by means of a flush valve 6. The discharge valve 2, the water valve 5 and the flush valve 6 are controlled by a control mechanism 7 provided with an activating means 8 for activating a flushing sequence. In this embodiment, the control mechanism 7 is pneumatically or electrically governed using vacuum drawn from the vacuum piping 3 as indicated by a broken line. Vacuum is generated in the vacuum piping 3 by means of a vacuum unit 9.

The operation of the vacuum sewage system, comprising carrying out the flushing sequence, i.e. a discharge of the gravity toilet bowl, according to the invention is as follows. When sewage has been disposed in the gravity toilet bowl 1, the activating means 8 is activated (by pressing a push button), whereby the control mechanism 7 receives a pneumatic or electric signal from the activating means. Vacuum is thus conveyed from the vacuum sewer piping 3 to the discharge valve 2, the water valve 5 and the flush valve 6 for opening these three valves. The vacuum connection between the control mechanism 7 and the water valve 5, the flush water tank 4 and the flush valve 6 is indicated by broken lines.

Consequently, the sewage disposed in the toilet bowl 1 is directly discharged from the gravity toilet bowl 1 through the water trap 11 and the outlet 12, provided with the adapter 13, into the vacuum sewer piping 3 through the discharge valve 2 as the small amount of flush water from the flush water tank 4 at the same time is flushed into the gravity toilet bowl 1 by way of gravity.

After the flushing sequence, the discharge valve 2 and the flush valve 6 are closed. The flush water 6 closes with a given delay in order to ensure that the water trap 11 is filled with water in the same manner as in connection with a standard gravity toilet system. After a predetermined delay, i.e. when the flush water tank 4 has been filled with water to a predetermined degree, the water valve 5 is closed. Thus, the system is ready for a new flushing sequence.

The toilet arrangement according to the present invention only requires a small amount of flush water, in an amount between 2-3 liters, whereby the flush water tank can be dimensioned significantly smaller than in a standard gravity system. This provides an important advantage in view installation space compared to a standard gravity system. Clearly, this also has an important water saving aspect. It also reduces the total amount of waste to be handled.

Also the complicated flush system of a standard gravity system, which is apt to failure and leakage, e.g. because of the float system in the flush water tank, can be replaced by a single valve with a controlled delay function as described above. A further important aspect is the water trap, which functions as a labyrinth significantly reducing the flushing noise normally associated with vacuum toilets.

Taking into account that the other operational components are of a small size, all necessary operational components can practically be installed in a space above the toilet bowl as illustrated in FIG. 5. FIG. 5 illustrates an embodiment with a so-called upwards connection, whereby the discharge valve 2 is also identified as being above the toilet bowl 1. In this embodiment, the adapter 13 would be connected to the outlet 12 of the toilet bowl 1, and the pipe section, indicated with reference numeral 14 in FIG. 4, would rise up to a position above the toilet bowl 1 in order to connected to the discharge valve 2, which in this embodiment would be directly accessible from above the toilet bowl 1. The pipe section 14 would thus preferably have a diameter corresponding to a vacuum sewer piping, i.e. the above mentioned given second diameter.

In connection with a so-called downwards connection, the discharge valve would be arranged in the vicinity of the outlet of the toilet bowl.

This allows for easy access, installation, replacement and maintenance. Furthermore, the toilet bowl together with the operational components can be assembled as a package that can easily just be connected to the vacuum sewer piping. Advantageously, the operational components would be mounted on a frame structure arranged on the back side of the toilet bowl.

Furthermore, the vacuum sewer piping only has a diameter of about 40-50 mm, which requires less space than a traditional gravity sewer. A vacuum sewer piping, as known in the art, can be flexibly installed, with e.g. an upwards connection (riser pipe) form the toilet bowl, or alternatively e.g. a downwards connection. The vacuum sewer piping can be installed and changed as desired with a considerably degree of flexibility.

By deploying a simple pipe connection, an adapter as discussed above, the toilet bowl type is not limited to a specific vacuum toilet bowl. Any gravity toilet bowl type can be used, which gives freedom of design and installation, which are important criteria in the building and housing sectors.

The drawings and the description related thereto are only intended for clarification of the basic idea of the invention. The invention may vary in detail with the scope of the ensuing claims.

The invention claimed is:

1. A toilet arrangement, comprising:

a gravity toilet bowl provided with a water trap and an outlet having a diameter corresponding to a given first diameter of a gravity sewer pipe;

a flush water tank-connected to a source of water by a water valve and to the gravity toilet bowl by a flush valve for providing flush water to the gravity toilet bowl during a flushing sequence;

a push button;

a vacuum sewer piping with a given second diameter, the given second diameter being less than the given first diameter of the gravity sewer pipe;

a discharge valve having a diameter corresponding to the given second diameter of the vacuum sewer piping;

a vacuum unit connected to the vacuum sewer piping for generating vacuum in the vacuum sewer piping;

an adapter fluidly coupled between the outlet of the gravity toilet bowl, having the given first diameter of the gravity sewer pipe, and the discharge valve, having the given second diameter of the vacuum sewer piping, wherein a first end of the discharge valve is directly connected to the outlet of the gravity toilet bowl by the adapter, and a second end of the discharge valve, opposite to said first end, is directly connected to the vacuum sewer piping;

a controller configured to be activated by the push button and operatively connected to the vacuum sewer piping, the discharge valve, the water valve, the flush valve, and the vacuum unit whereby sewage disposed in the gravity toilet bowl is arranged to be directly discharged from the gravity toilet bowl through the water trap and the outlet provided with the adapter into the vacuum sewer piping through the discharge valve in connection with the flushing sequence.

2. The toilet arrangement according to claim 1, wherein the water valve, the flush water tank, the flush valve, the controller and the push button are located above the gravity toilet bowl.

3. The toilet arrangement according to claim 1, wherein the discharge valve is located above the gravity toilet bowl.

4. The toilet arrangement according to claim 1, wherein the flush water tank has a volume between 2-3 liters.

5. The toilet arrangement according to claim 1, wherein the gravity toilet bowl is of a wall mounted type.

6. The toilet arrangement according to claim 1, wherein the gravity toilet bowl is of a floor supported type.

* * * * *